US009837771B2

(12) United States Patent
Tedeschi

(10) Patent No.: US 9,837,771 B2
(45) Date of Patent: Dec. 5, 2017

(54) ELECTRICAL CONNECTOR WITH SHORT CIRCUIT ELEMENT

(71) Applicant: INDUSTRIA LOMBARDA MATERIALE ELETTRICO I.L.M.E. S.P.A., Milan (IT)

(72) Inventor: Tito Alessandro Tedeschi, Bollate (IT)

(73) Assignee: INDUSTRIA LOMBARDA MATERIALE ELETTRICO I.L.M.E. S.P.A., Milan (IT)

( * ) Notice: Subject to any disclaimer, the term of this patent is extended or adjusted under 35 U.S.C. 154(b) by 0 days.

(21) Appl. No.: 15/075,444

(22) Filed: Mar. 21, 2016

(65) Prior Publication Data

US 2016/0285211 A1 Sep. 29, 2016

(30) Foreign Application Priority Data

Mar. 23, 2015 (IT) ..... MI2015A0430

(51) Int. Cl.
*H01R 29/00* (2006.01)
*H01R 13/703* (2006.01)
(Continued)

(52) U.S. Cl.
CPC ..... *H01R 13/7032* (2013.01); *H01R 13/6271* (2013.01); *H01R 24/20* (2013.01);
(Continued)

(58) Field of Classification Search
CPC ..... H01R 13/7032
See application file for complete search history.

(56) References Cited

U.S. PATENT DOCUMENTS 6,315,588 B1 11/2001 Heberlein et al.
6,682,364 B2 * 1/2004 Cisey ..... H01R 9/2666 439/441

(Continued)

FOREIGN PATENT DOCUMENTS

| | | |
|---|---|---|
| FR | 2947675 | 1/2011 |
| JP | 6203920 | 7/1994 |
| WO | 8809070 | 11/1988 |

OTHER PUBLICATIONS

European Search Report dated Nov. 10, 2015; Application No. IO53970/IT MI20150430.

*Primary Examiner* — Tho D Ta
(74) *Attorney, Agent, or Firm* — Young & Thompson

(57) ABSTRACT

A plug connector includes a first connector half configured as a socket connector and a second connector half configured as a plug connector, each of the connector halves including an insulating body housing at least a respective pair of electric contact elements, respectively female and male, a short-circuit element being provided between the contacts of the socket connector half, adapted to hold such contacts shorted upon unmated connector, wherein the short-circuit element is made from a strip of resilient metallic material, shaped so as to constitute a spring and to offer, at each of its ends, a resilient contact, the first end of the short-circuit element being substantially rigid and stable in contact with a respective female electric contact element, while the second end of the short-circuit element, upon plug connector unmated, goes intimately into contact with the other element of female electrical contact of the socket connector.

14 Claims, 8 Drawing Sheets

(51) Int. Cl.

| | |
|---|---|
| ***H01R 13/627*** | (2006.01) |
| ***H01R 24/20*** | (2011.01) |
| ***H01R 24/28*** | (2011.01) |
| *H01R 107/00* | (2006.01) |

(52) U.S. Cl.
CPC ..... *H01R 24/28* (2013.01); *H01R 2107/00* (2013.01); *H01R 2201/22* (2013.01)

(56) References Cited

U.S. PATENT DOCUMENTS

| | | | | |
|---|---|---|---|---|
| 7,204,727 | B2 * | 4/2007 | Germani | H01R 4/4827 439/106 |
| 7,275,946 | B2 * | 10/2007 | Ohtaka | H01R 13/7032 200/51.1 |
| 7,438,587 | B2 * | 10/2008 | Germani | H01R 4/4836 439/441 |
| 7,892,043 | B1 * | 2/2011 | Orand | H01R 13/6453 439/681 |
| 8,911,263 | B2 * | 12/2014 | Becavin | H01R 13/64 439/680 |

* cited by examiner

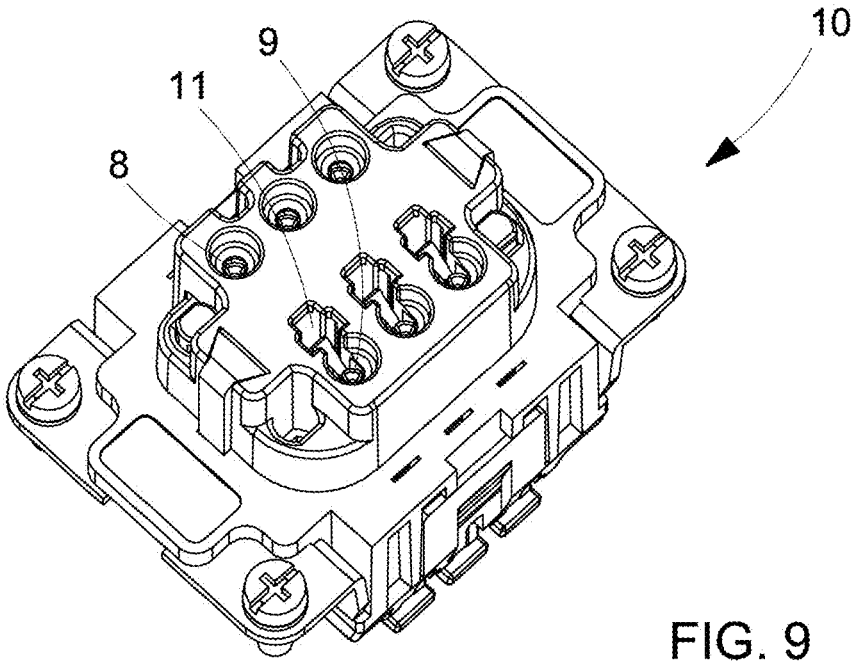
FIG. 9
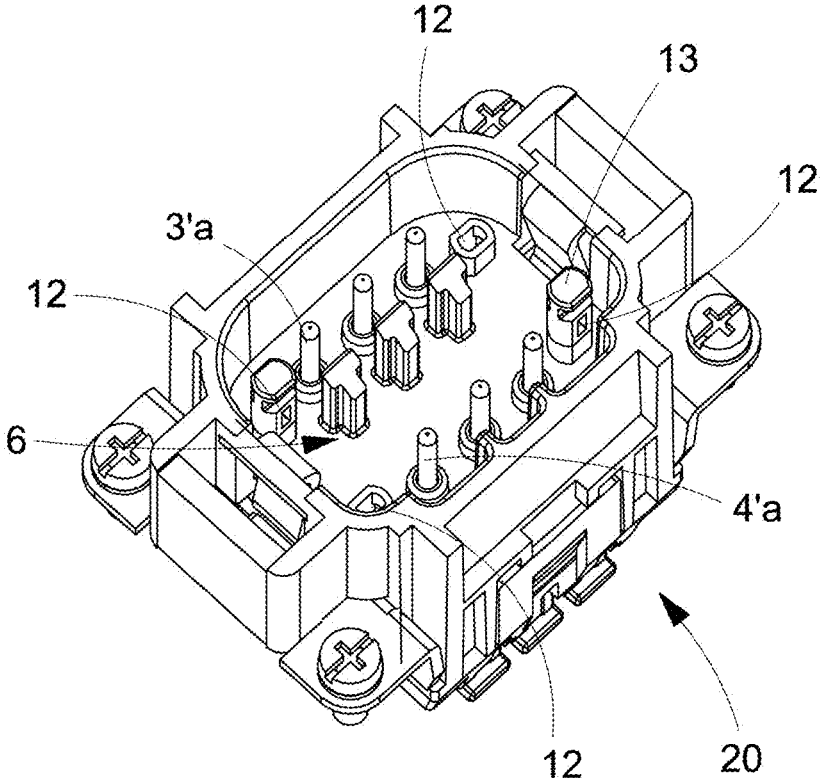

ELECTRICAL CONNECTOR WITH SHORT CIRCUIT ELEMENT

FIELD OF THE INVENTION

The present invention relates to an electrical connector provided with a short-circuit element.

In particular, the invention relates to a plug-type connector, comprising a female connector element (or insert) or socket and a male connector element or plug, in which the shorting is provided of the output terminals connected to the socket contacts, for example those of the secondary winding of a measuring current transformer (a.k.a. "amperometric transformer" or CT), before the corresponding plug is fully withdrawn from the socket.

This measure is imposed to avoid the appearance, at the circuit heads, of a hazardous electric voltage, likely to determine—upon "open circuit"—a disruptive discharge in the circuit of the socket and an hazardous condition for the staff who had inadvertently operated the opening of the secondary circuit with the primary still connected.

BACKGROUND OF THE INVENTION

Numerous plug connectors and connecting devices are known in prior art which provide, with appropriate means, to automatically achieve the short-circuit upstream of the removable connector element (connector plug) before the complete opening of the contacts of the same, to avoid opening, hence leaving it "unladen", the electric circuit upstream of the device itself.

For example, U.S. Pat. No. 4,988,307 describes a plug connector system that comprises a pair of contacts which are shorted between them until not mated with another pair of contacts, by means of a device operated by a spring. Said spring is however made captive in the insulating body of the plug connector and both its end portions act as spring towards their respective electric contact elements. The insulating body of the connector has a groove (slot) in which the median part of the elastic element is made captive. The spring is largely in the shape of a Z. The contacts of the first plug connector half are one male and one female, those of the corresponding second plug connector half are respectively female and male. The female contacts are surrounded by a tube of insulating material which, interposed between the contact and the spring determines, during the mating of the two plug connector halves, the opening of the short circuit.

The patent U.S. Pat. No. 4,988,307 (ITT Corp.) provides contacts equipped of a wrap-around tubule made of insulating material and an actuator pin having a shaped tip with an inclined plane (wedge) that operates the deflection of an arm of an elastic spring element.

All the known embodiments are complex, incorporating additional contact elements in series, or elastic elements, like pressure springs, additional to the element that realizes the short-circuit, the assembly resulting in such a way complex, the cost high and the reliability compromised.

SUMMARY OF THE INVENTION

Object of the invention is to eliminate the drawbacks of prior art.

In particular, one object of the invention is to provide an electrical plug connector that ensures the shorting of the output terminals, connected to the socket contacts, before the corresponding plug is fully withdrawn from the socket.

Another object of the invention is to provide such an electrical plug connector which is of simple construction and manufactured with a reduced number of components. Yet another object of the invention is to provide such an electrical connector which is of economical construction and highly reliable.

These and other objects are achieved by the electrical plug connector according to the invention, which has the characteristics of independent claim 1.

Advantageous embodiments of the invention are apparent from the dependent claims. Basically, the electrical plug connector according to the invention comprises a first connector half configured as a socket connector and a second connector half configured as a plug connector, each of said connector halves comprising an insulating body housing at least a respective pair of electrical contact elements arranged in parallel and each having a front end, on the mating side, shaped in the first connector half in the manner of a bushing or female contact and in the second connector half in the manner of a pin or male contact, and a rear end, on the wiring side, suitable for housing a respective conductor for connection to an electrical circuit, a short-circuit element being provided between said contacts of the socket connector half adapted to hold such contacts shorted upon unmated plug connector, in which said short-circuit element is constituted by a strip of resilient metallic material, shaped so as to constitute a spring and to offer to each of its ends an elastic contact, the first end of said short-circuit element being in stable and substantially integral contact with a respective female electrical contact element, while the second end of said short-circuit element, upon unmated plug connector, goes intimately into contact with the other element of female electrical contact of said at least one pair of contacts of the socket connector, an opening being present on the mating face between the access openings to said at least a pair of female contacts accommodated in said first half of the plug connector, directed towards said other end of said short-circuit element, a plug actuator pin of insulating material being correspondingly formed in said second connector half, between said at least one pair contacts, such that in the mated position of the plug connector, said plug actuator pin is inserted in said opening of the socket connector half and is interposed between said second end of said short-circuit element and said contact, opening the short-circuit previously operated by said short-circuit element.

BRIEF DESCRIPTION OF THE DRAWINGS

Additional features of the invention will be appear more clear by the detailed description that follows, referring to a merely exemplary, and therefore non-limiting embodiment thereof, illustrated in the appended drawings, in which:

FIG. 9 shows in perspective the two halves, respectively socket and plug of a plug connector according to the present invention.

DETAILED DESCRIPTION OF THE INVENTION

Figure 1:
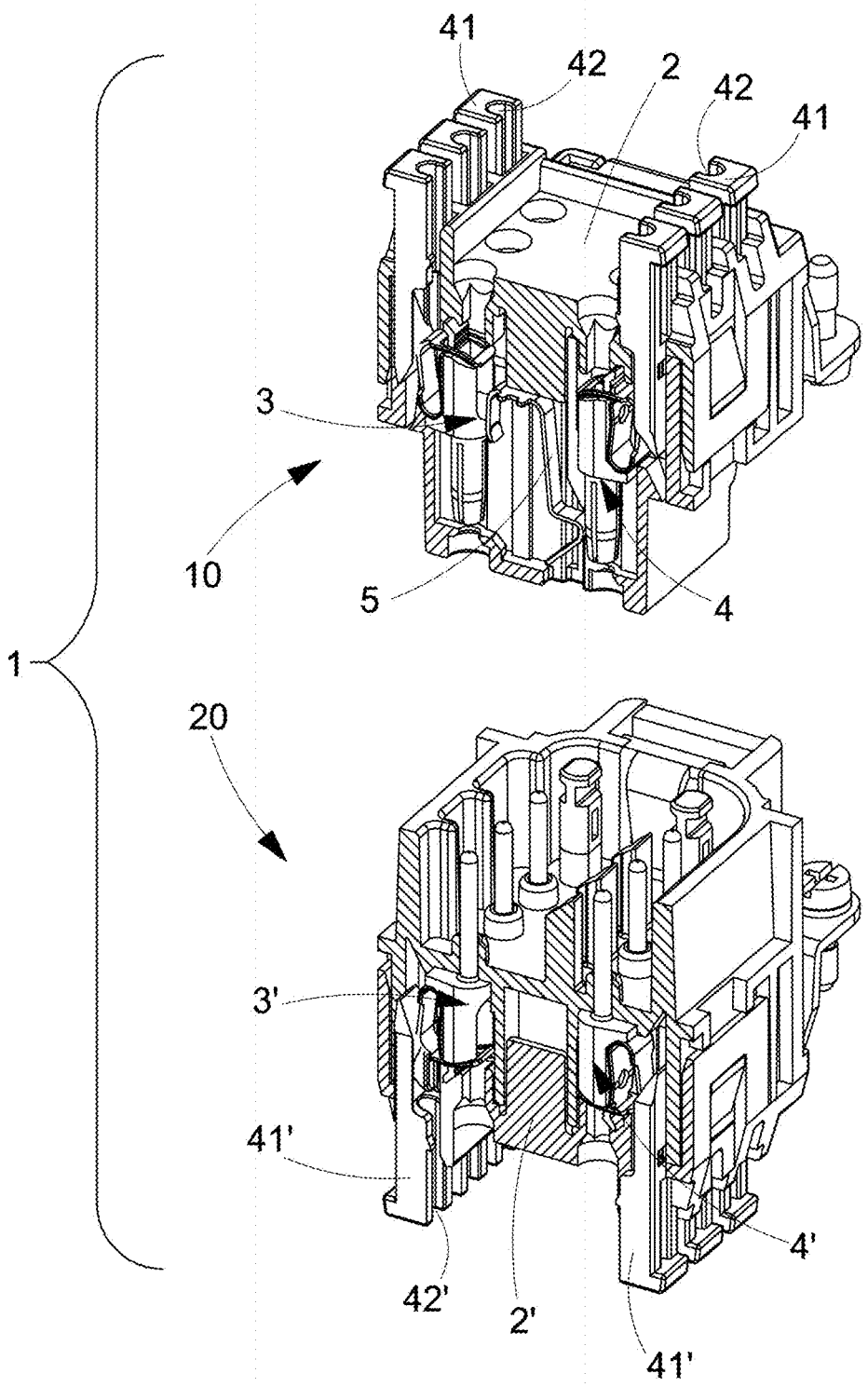
FIG. 1 shows a perspective view of a plug connector according to the invention, with the two elements of the plug connector, respectively socket and plug unmated and both sectioned with a vertical plane in order to highlight the internal elements of the same.
Figure 2:
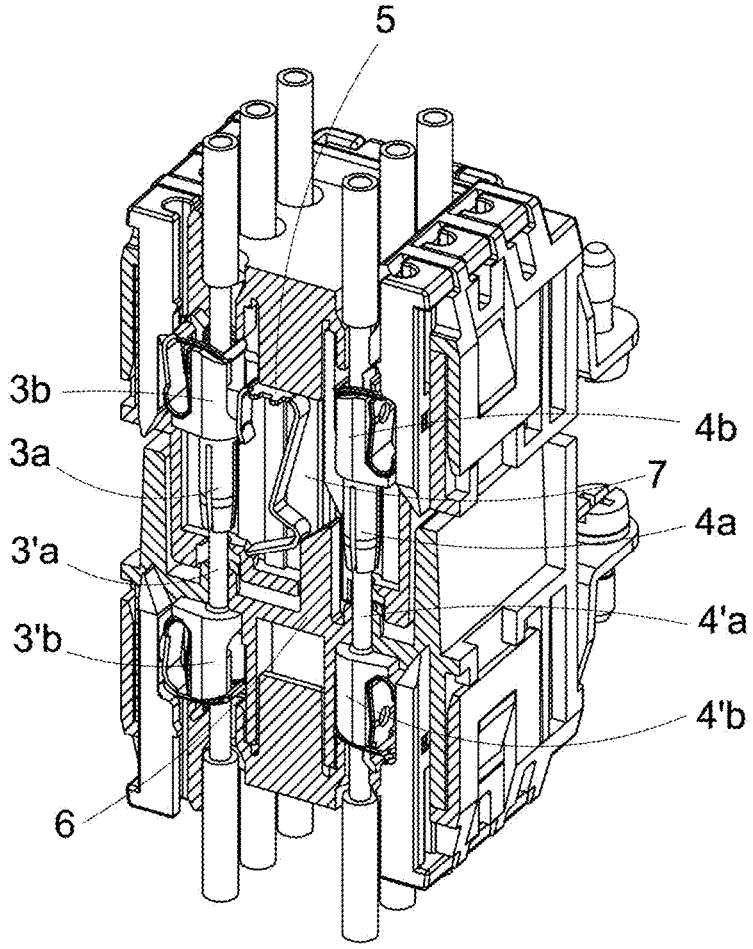
FIG. 2 shows the plug connector of FIG. 1 in the fully mated position.

With reference to these figures, a plug connector according to the invention, globally indicated by the reference number 1, comprises a first element or connector half socket-type 10 having an insulating body 2 provided with at least a pair of facing contacts of the female type 3, 4 each having a front end 3*a*, 4*a* shaped in the manner of a bushing and a rear end 3*b*, 4*b* for housing a respective conductor 40 for connection to an electric circuit, and an element or connector half plug-type 20 having an insulating body 2' provided with at least a corresponding pair of male contacts, 3', 4', each having a front end 3'*a*, 4'*a* shaped in the manner of a pin and a rear end 3'*b*, 4'*b* adapted to house a respective conductor 40'.

In the appended figures, the female contact 3, 4 and male contacts 3', 4' are provided with spring-clamp terminals 43, 43', as foreseen for example in the multipole plug connector of the patent application MI2012A 001974 in the name of the same applicant ILME S.P.A., and are adapted to lock the respective conductors 40, 40' by means of the respective actuator pins 41, 41' which, in this case, are provided with longitudinally extended opening 42, 42', for the access of the probe to a test device to allow electrical measurements.

However, it is evident that the plug connector 1 can be of any other type and the locking of the conductors 40, 40' can be, for example, of the screw type, of the insulation piercing type or of the insulation displacement type, or the like.

Between contacts 3, 4 of the socket connector half 10 a short-circuit element 5 is provided, best seen in FIGS. 3-6, in the form of a strip of resilient conductive material with a spring function and shaped so as to offer to both its ends 5*a*, 5*b* an elastic contact. The first end 5*a* is a substantially integral contact with a respective female contact 3, while the other end 5*b*, upon unmated plug connector 1, goes intimately into contact with the other socket contact 4 of said at least one pair of contacts of the socket connector 10.

As best seen in FIG. 9, on the mating face of the first socket connector half 10, between the two access openings 8, 9 of the corresponding male contacts 3', 4' of the second plug connector half 20 to the respective aforementioned female contacts 3, 4, an opening 11 suitably shaped (in this case with a profile substantially T) is also present, adapted to receive a corresponding actuator pin 6 arranged on the mating face of the second plug connector half 20, between the two front portions 3'*a* and 4'*a* of the respective pin contacts.

Upon plug connector 1 unmated—i.e. socket connector 10 and plug connector 20 completely separate—said short-circuit element 5 therefore operates a bridge between the two female contacts 3, 4 of the socket connector 10.

In the second connector plug connector half 20 fitted with male contacts a corresponding actuator pin 6 is present, between each pair of facing male contacts 3', 4', integral with the insulating body of said second plug connector half 20, having a substantially prismatic development, reproducing the T-shape of said opening 11, and with upper end 6' wedge-shaped. The actuator pin 6 can be made in a single piece with the body 2' of the plug connector half 20, or be reported on it.

Figure 3:
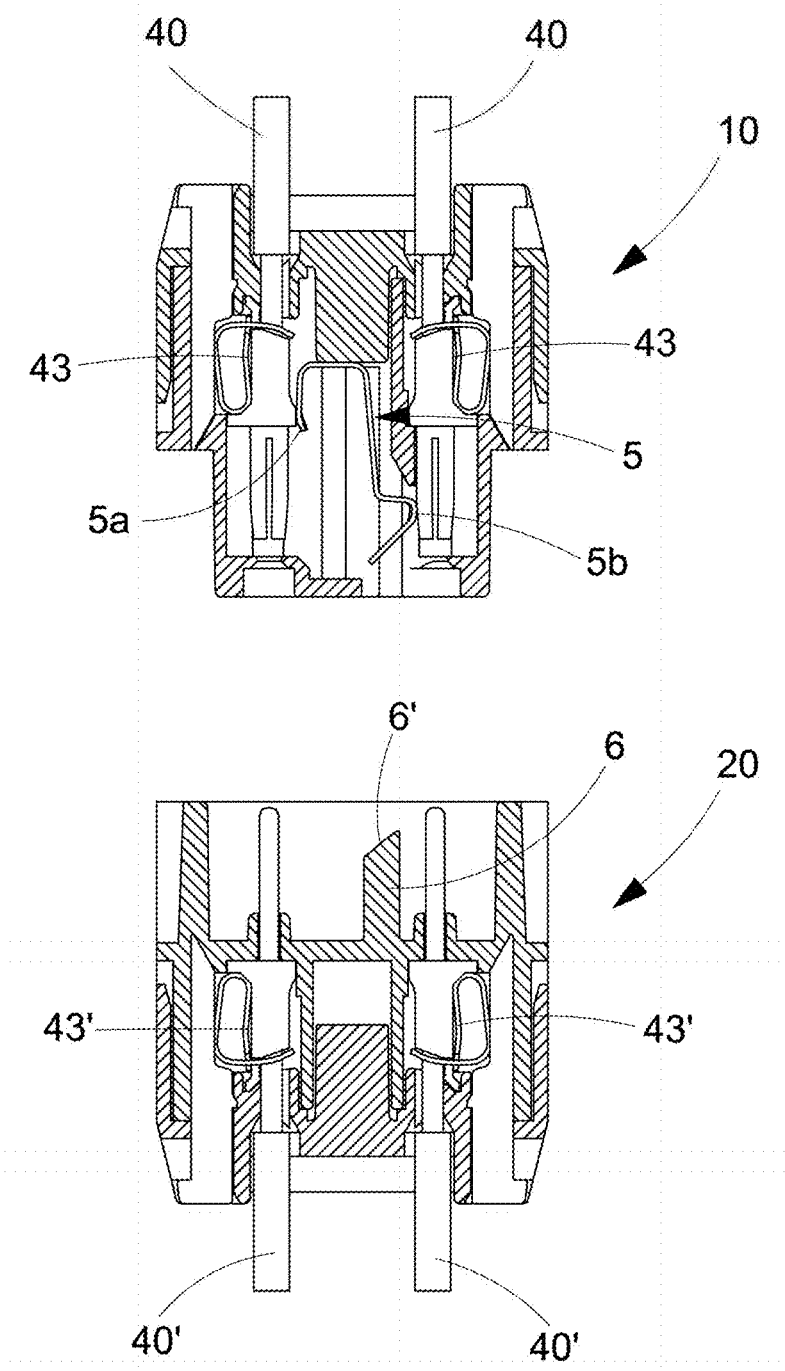
FIGS. 3, 4, and 5 show in cross-section the plug connector wired and respectively unmated (FIG. 3), in the initial mating position but with short-circuit element still active (FIG. 4) and in the position of full mating with short-circuit element fully open by means of the plug actuator pin (FIG. 5).
Figure 4:
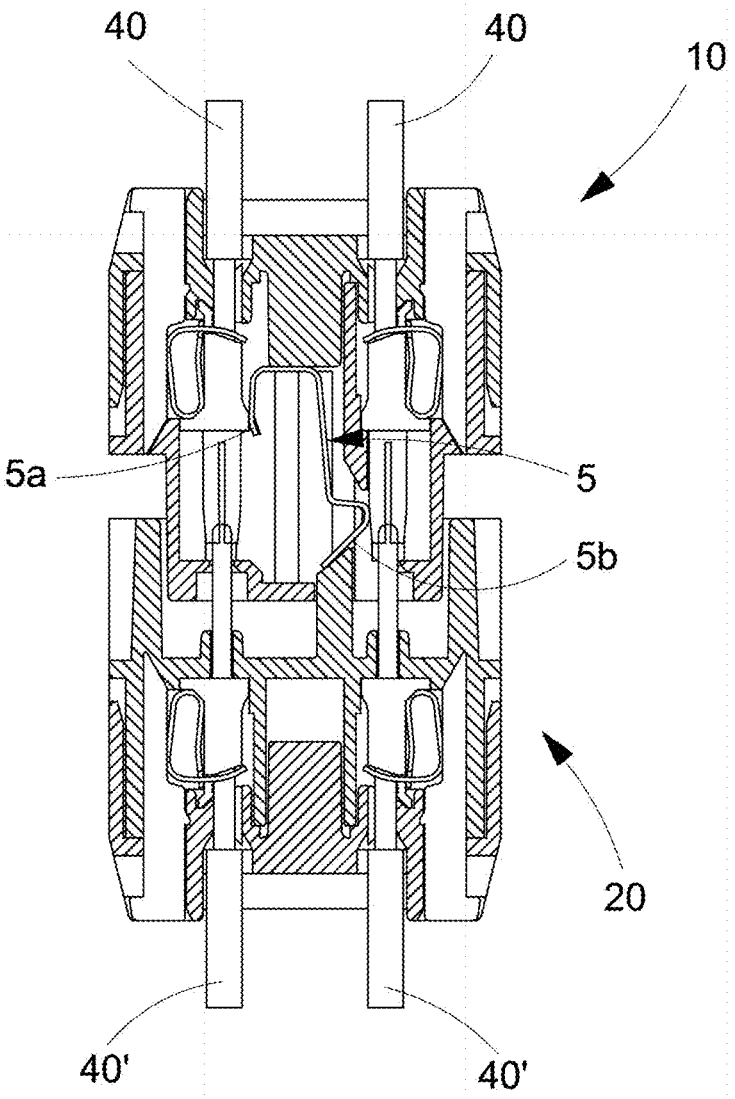
Figure 5:
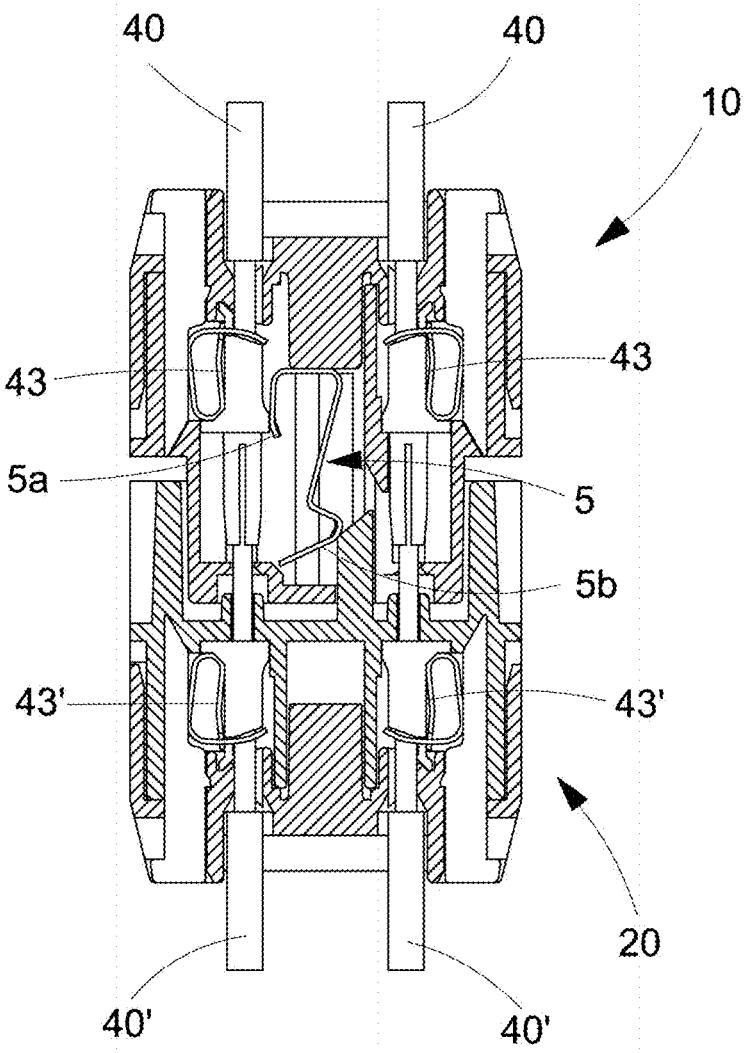
Figure 6A:
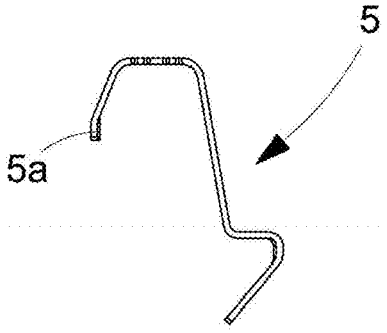
FIGS. 6*a*), *b*) show respectively a side view and a perspective view of the short-circuit element.
Figure 6B:
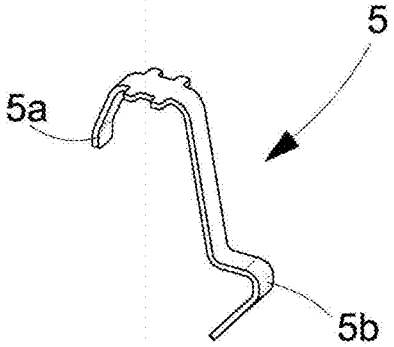
Figure 7:
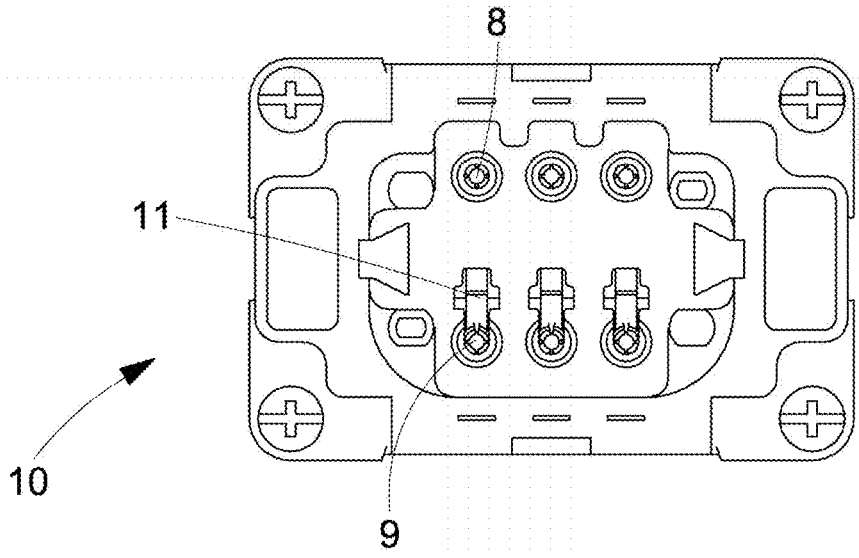
FIGS. 7 and 8 are front views respectively of the socket element and plug element of a plug connector according to the invention.
Figure 8:
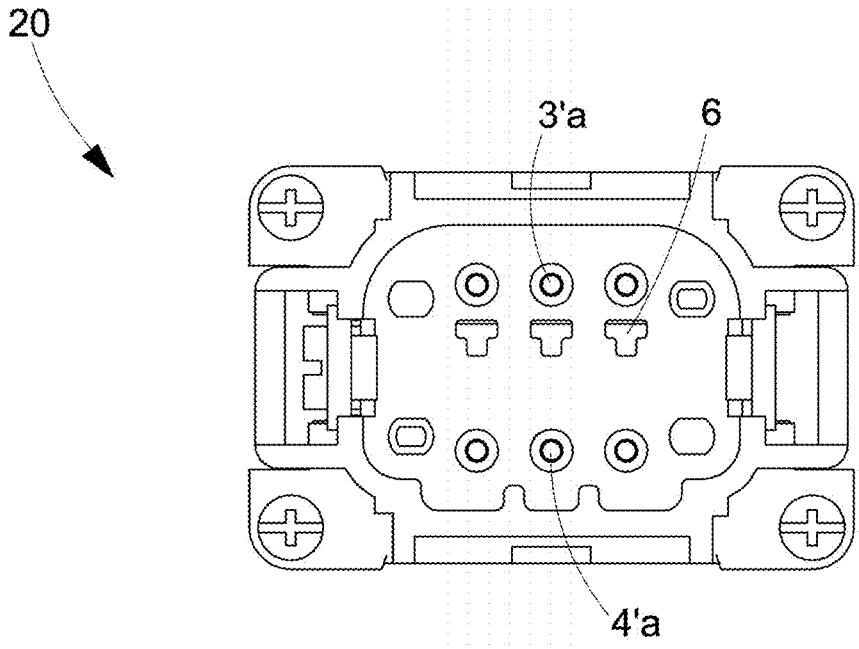

With reference to FIGS. 3, 4 and 5, during mating (closing) of the two connector halves respectively socket 10 and plug 20, said pin 6, with a suitable delay compared with the electrical coupling between the corresponding male contacts 3', 4' and female contacts 3, 4, operates the progressive opening of the short-circuit element 5 placed between the two female contact elements 3, 4 in the first socket half 10 of plug connector 1 (socket connector), operating a eversion of the respective spring arm and the opening of the contact between the end 5*b* and the corresponding female contact 4. Contextually, said actuator pin 6, made of insulating material, restores, upon plug connector half 20 mated to the corresponding socket connector half 10, the necessary electrical insulation between the two facing parts of female contact 3, 4.

Coding pins 13 are also visible in the appended figures, normally colour-coded, mounted in corresponding seats 12 for a correct coupling of the connectors.

Naturally the invention is not limited to the particular embodiment previously described and illustrated in the appended drawings, but it can be subject to numerous modifications of detail within the reach of the skilled in the art, without departing from the scope of the invention itself, as defined in the following claims.

The invention claimed is:

1. A connector assembly (1) comprising:

a first connector half (10) configured as a socket connector; and a second connector half (20) configured as a plug connector, each of said first and second connector halves (10; 20) comprising an insulating body (2; 2') respectively housing at least a pair of electrical contact elements (3, 4; 3', 4'), arranged parallel to each other and each having a front end (3*a*, 4*a*; 3'*a*, 4'*a*), at a mating side, shaped in the first connector half (10) as a female contact and in the second connector half (20) as a male contact, and a rear end (3*b*, 4*b*; 3'*b*, 4'*b*), on a wiring side, suitable for housing a respective conductor (40, 40') for connection to an electric circuit, a short-circuit element (5) being provided between said electrical contact elements (3, 4) of the first connector half (10), suitable for keeping short-circuited said electrical contact elements when the connector assembly (1) is decoupled, wherein said short-circuit element (5) consists of a strip of resilient metallic material with first and second ends (5*a*, 5*b*), shaped so as to define a spring and to offer an elastic contact to each of the first and second ends (5*a*, 5*b*), the first end (5*a*) of said strip of resilient metallic material (5) being in stable and substantially joint contact with the rear end (3*b*, 4*b*; 3'*b*, 4'*b*) of a first of the female electrical contact elements (3), while the second end (5*b*) of said strip of resilient metallic material (5), when the connector assembly (1) is unmated, is in intimate contact with the front end (3*a*, 4*a*; 3'*a*, 4'*a*) of a second of the female electrical contact elements (4) of said at least one pair of electrical contact elements of the first connector half (10), wherein an opening (11) is provided on a mating face between access openings (8, 9) to said female contacts (3,4) housed in said first connector half (10), headed towards said second end (5*b*) of said strip of resilient metallic material (5), wherein a plug actuator pin (6) in insulating material is included in said second connector half (20), between said at least one pair of electrical contact elements (3', 4'), such that, with the connector assembly (1) in a mated position, said plug actuator pin (6) is inserted in said opening (11) of the first connector half (10) and interposed between said second end (5*b*) of said strip of resilient metallic material (5) and said second female electrical contact element (4), moving the second end (5*b*) of said strip of resilient metallic material (5) from the intimate contact with the front end (3*a*, 4*a*; 3'*a*, 4'*a*) of the second female electrical contact element (4) of the socket first connector half (10), and thereby opening the short circuit previously operated by said strip of resilient metallic material (5).

2. The connector assembly (1) according to claim 1, wherein said plug actuator pin (6) has a wedge-shaped end (6') with the inclined surface heading towards a corresponding second end (5*b*) of said strip of resilient metallic material (5), so that, in the mating side of said first and second connector halves (10, 20), said second end (5*b*) of said strip of resilient metallic material (5) comes into contact with said wedge-shaped end of said plug actuator pin (6) gradually being everted.

3. The connector assembly (1) according to claim 1, wherein said plug actuator pin (6) is formed as an integral part of the insulating body (2') of said second connector half (20).

4. The connector assembly (1) according to claim 1, wherein said plug actuator pin (6) is an element reported on the insulating body (2') of said second connector half (20).

5. The connector assembly (1) according to claim 1, wherein said plug actuator pin (6) has a prismatic shape with a substantially T-shaped cross-section.

6. The connector assembly (1) according to claim 1, wherein the insulating bodies (2, 2') are provided with seats (12) for the housing of coding pins (13).

7. The connector assembly (1) according to claim 1, wherein the electrical contact elements of the insulating bodies (2, 2') are provided with spring-clamp terminals that, under a pushing action release a previously held compressed spring, so as to lock the conductor in the spring-clamp terminal.

8. The connector assembly (1) according to claim 7, wherein the insulating bodies (2, 2') are provided with respective actuators pins (41, 41'), for the actuation of a spring of each of the spring-clamp terminals (43, 43').

9. The connector assembly (1) according to claim 8, wherein said actuating pins (41, 41') are provided with a longitudinally extended opening (42, 42'), for the access of a probe of a testing device to allow electrical measurements.

10. The connector assembly (1) according to claim 1, wherein only one or more pairs of the electrical contact elements are equipped with the short-circuit element (5), while the other pairs of the electrical contact elements are without the short-circuit element (5).

11. The connector assembly (1) according to claim 1, wherein said plug actuator pin (6) is formed as an integral part of the insulating body (2') of said second connector half (20).

12. The connector assembly (1) according to claim 1, wherein said plug actuator pin (6) is an element reported on the insulating body (2') of said second connector half (20).

13. The connector assembly (1) according to claim 1, wherein, said strip of resilient metallic material (5) extends along a length direction and has a mid-portion located between the first end (5*a*) and the second end (5*b*) of said strip of resilient metallic material (5), the mid-portion of said strip of resilient metallic material (5) has a width greater than a width the first end (5*a*) and of said strip of resilient metallic material (5) and greater than a width of the second end (5*b*) of said strip of resilient metallic material (5), when the connector assembly (1) is unmated, the first end (5*a*) of said strip of resilient metallic material (5) is in stable and substantially joint contact with the rear end (3*b*) of the first female electrical contact element (3), the second end (5*b*) of said strip of resilient metallic material (5), is in intimate contact with the front end (4*a*) of the second female electrical contact element (4) of said at least one pair of electrical contact elements of the first connector half (10), and the mid-portion of said strip of resilient metallic material (5) is against a portion of the insulating body (2) of said first connector half (10).

14. The connector assembly (1) according to claim 13, wherein, a length of said strip of resilient metallic material (5) between the mid-portion located and the first end (5*a*) is less than a length of said strip of resilient metallic material (5) between the mid-portion located and the second end (5*b*).

* * * * *